US008328184B1

(12) United States Patent
Lu et al.

(10) Patent No.: US 8,328,184 B1
(45) Date of Patent: Dec. 11, 2012

(54) PAPER FEEDING MECHANISM

(75) Inventors: Pei-Chun Lu, New Taipei (TW); Wen-Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/349,493

(22) Filed: Jan. 12, 2012

(51) Int. Cl.
*B65H 1/08* (2006.01)

(52) U.S. Cl. ..... 271/127; 271/152; 271/153

(58) Field of Classification Search ..... 271/117, 271/118, 126, 127, 147, 152–156
See application file for complete search history.

(56) References Cited

U.S. PATENT DOCUMENTS

| | | | | |
|---|---|---|---|---|
| 5,100,122 | A * | 3/1992 | Noda et al. | 271/155 |
| 5,228,676 | A * | 7/1993 | Arai et al. | 271/117 |
| 6,778,262 | B2 * | 8/2004 | Kaburagi et al. | 355/405 |
| 7,461,840 | B2 * | 12/2008 | Hattori | 271/110 |
| 7,497,430 | B2 * | 3/2009 | Kusumi | 271/10.03 |
| 7,971,868 | B2 * | 7/2011 | Matsushima et al. | 271/118 |
| 8,123,212 | B1 * | 2/2012 | Blair et al. | 271/126 |
| 8,210,521 | B2 * | 7/2012 | Blair et al. | 271/117 |
| 2003/0116906 | A1 * | 6/2003 | Amamoto | 271/126 |
| 2005/0087921 | A1 * | 4/2005 | Aoki et al. | 271/126 |
| 2006/0180987 | A1 * | 8/2006 | Hattori | 271/117 |
| 2010/0059929 | A1 * | 3/2010 | Okumura | 271/117 |
| 2011/0101600 | A1 * | 5/2011 | Chihara et al. | 271/152 |

* cited by examiner

*Primary Examiner* — Jeremy R Severson
(74) *Attorney, Agent, or Firm* — WPAT, P.C.; Anthony King

(57) ABSTRACT

A paper feeding mechanism includes a mechanical frame, a drive system mounted to the mechanical frame, an input tray pivoted to the mechanical frame, a controlling assembly, a pickup assembly and an elevating assembly. The pickup assembly includes a pickup roller and a pickup wheel pivoted to the pickup roller. The elevating assembly mounted to the mechanical frame is pivoted to the input tray. The controlling assembly includes a controlling system, a paper sensor, a floating sensor, and a pickup sensor detecting a position of the pickup assembly to get a total thickness of papers on the input tray. The controlling system controls the drive system to drive the elevating assembly to wiggle upward and downward to drive the input tray to rise and descend according to the total thickness of the papers on the input tray so as to make the pickup wheel pick up the papers steadily.

6 Claims, 3 Drawing Sheets

PAPER FEEDING MECHANISM

BACKGROUND OF THE INVENTION

1. Field of the Invention

The present invention generally relates to a paper feeding mechanism, and more particularly to a paper feeding mechanism capable of picking up papers steadily.

2. The Related Art

A conventional paper feeding mechanism includes a mechanical frame, a drive system, an input tray, an elevating assembly and a pickup assembly driven by the drive system. The drive system is mounted to the mechanical frame. A rear of the input tray is pivoted to the mechanical frame. The elevating assembly is mounted to the mechanical frame and located under the input tray. The pickup assembly is mounted to the mechanical frame and located above the input tray. After papers are put on the input tray, the drive system drives the elevating assembly to rise so as to drive the input tray to reach a constant level according to a total thickness of the papers. Then the pickup assembly starts picking up the papers. However, the total thickness of the papers becomes thinner and thinner after the pickup assembly picks up the papers for a while, but the input tray is still located at the constant level. As a result, the pickup assembly is further away from the papers on the input tray that weakens positive force exerted on the papers by the pickup assembly. So, the pickup assembly can't pick up the papers effectively.

SUMMARY OF THE INVENTION

An object of the present invention is to provide a paper feeding mechanism. The paper feeding mechanism includes a mechanical frame, a drive system mounted to the mechanical frame, an input tray for holding papers thereon, a pickup assembly, an elevating assembly and a controlling assembly. A rear of the input tray is pivoted to the mechanical frame. The pickup assembly is driven by the drive system and is located above the input tray. The pickup assembly includes a pickup roller, and a pickup wheel pivoted to one end of the pickup roller to wiggle upward and downward. The other end of the pickup roller is fastened to the mechanical frame for securing the pickup assembly to the mechanical frame. The elevating assembly is mounted to the mechanical frame and driven by the drive system. The elevating assembly is pivoted to a bottom of the input tray and brings along the input tray to rise and descend. The controlling assembly includes a controlling system, a paper sensor, a floating sensor and a pickup sensor. The paper sensor is mounted to the input tray with a top end thereof projecting beyond a top of the input tray to detect whether there are any papers on the input tray. The floating sensor is mounted to one side of the elevating assembly to detect a position of the elevating assembly. The pickup sensor is mounted to one side of the pickup assembly to detect a position of a bottom of the pickup wheel of the pickup assembly with respect to the papers on the input tray to get a total thickness of the papers located on the input tray. The controlling system controls the drive system to drive the elevating assembly to wiggle upward and downward to bring along the input tray to rise and descend according to the total thickness of the papers located on the input tray, so as to make the pickup wheel of the pickup assembly pick up the papers on the input tray steadily.

As described above, the paper feeding mechanism detects the position of the bottom of the pickup wheel of the pickup assembly with respect to the papers on the input tray through the pickup sensor to get the total thickness of the papers on the input tray so as to modulate a position of the input tray in actual time to ensure the bottom of the pickup wheel of the pickup assembly to touch the papers on the input tray really. As a result, the bottom of the pickup wheel presses on the papers through the steady positive force so as to make the pickup wheel pick up the papers on the input tray steadily.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
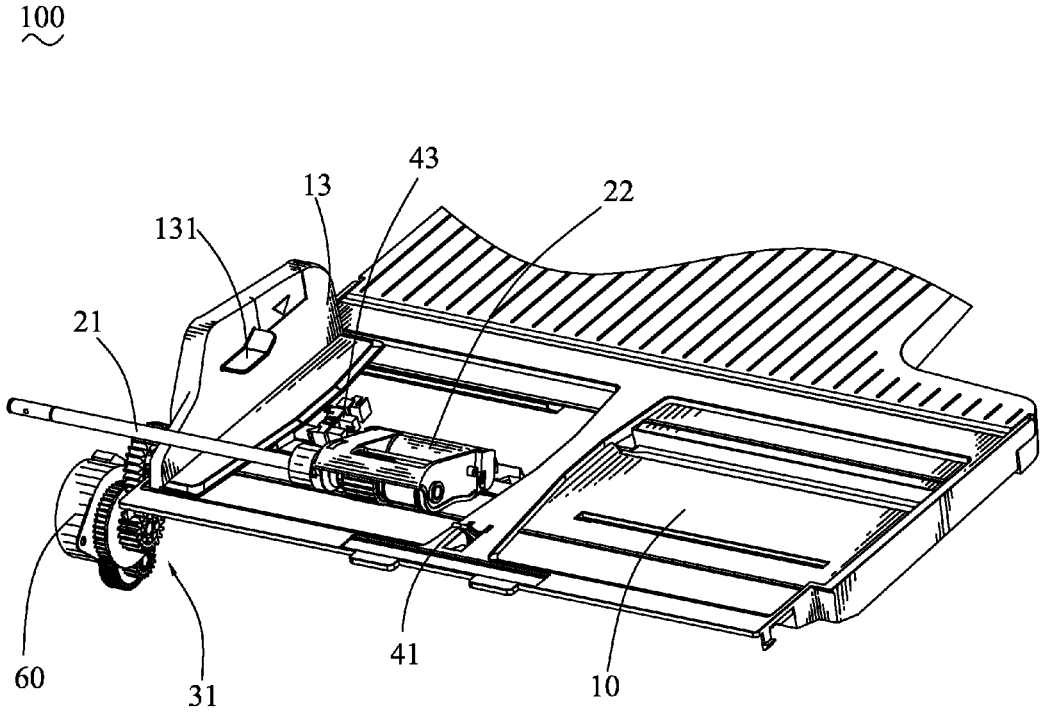
FIG. 1 is a perspective view of a paper feeding mechanism in accordance with the present invention.
Figure 2:
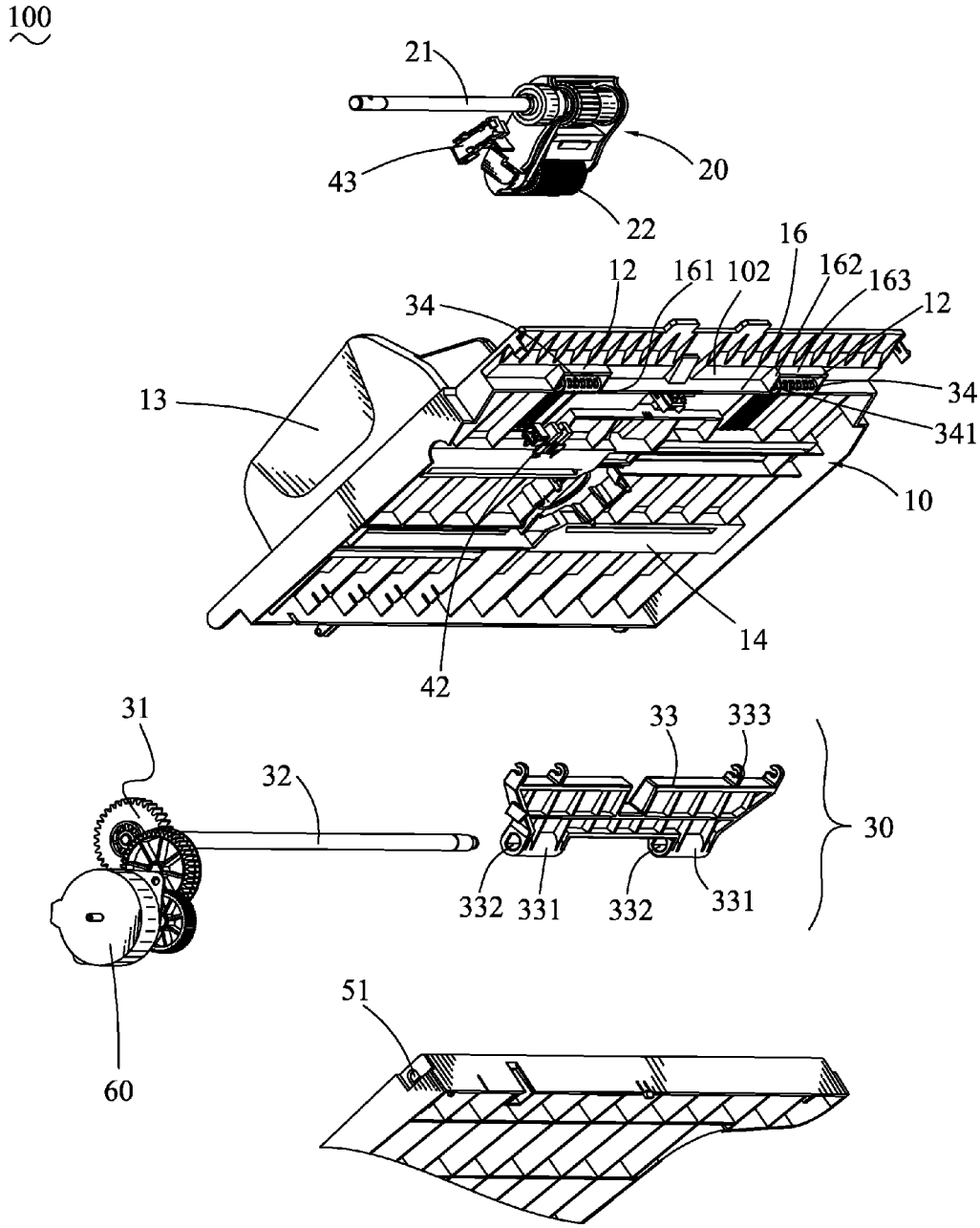
FIG. 2 is an exploded view of the paper feeding mechanism of FIG. 1.

With reference to FIG. 1 and FIG. 2, a paper feeding mechanism 100 in accordance with the present invention is shown. The paper feeding mechanism 100 includes a mechanical frame (not shown), a drive system 60 mounted to the mechanical frame, an input tray 10, a controlling assembly (not labeled), a pickup assembly 20 and an elevating assembly 30 driven by the drive system 60.

Figure 3:
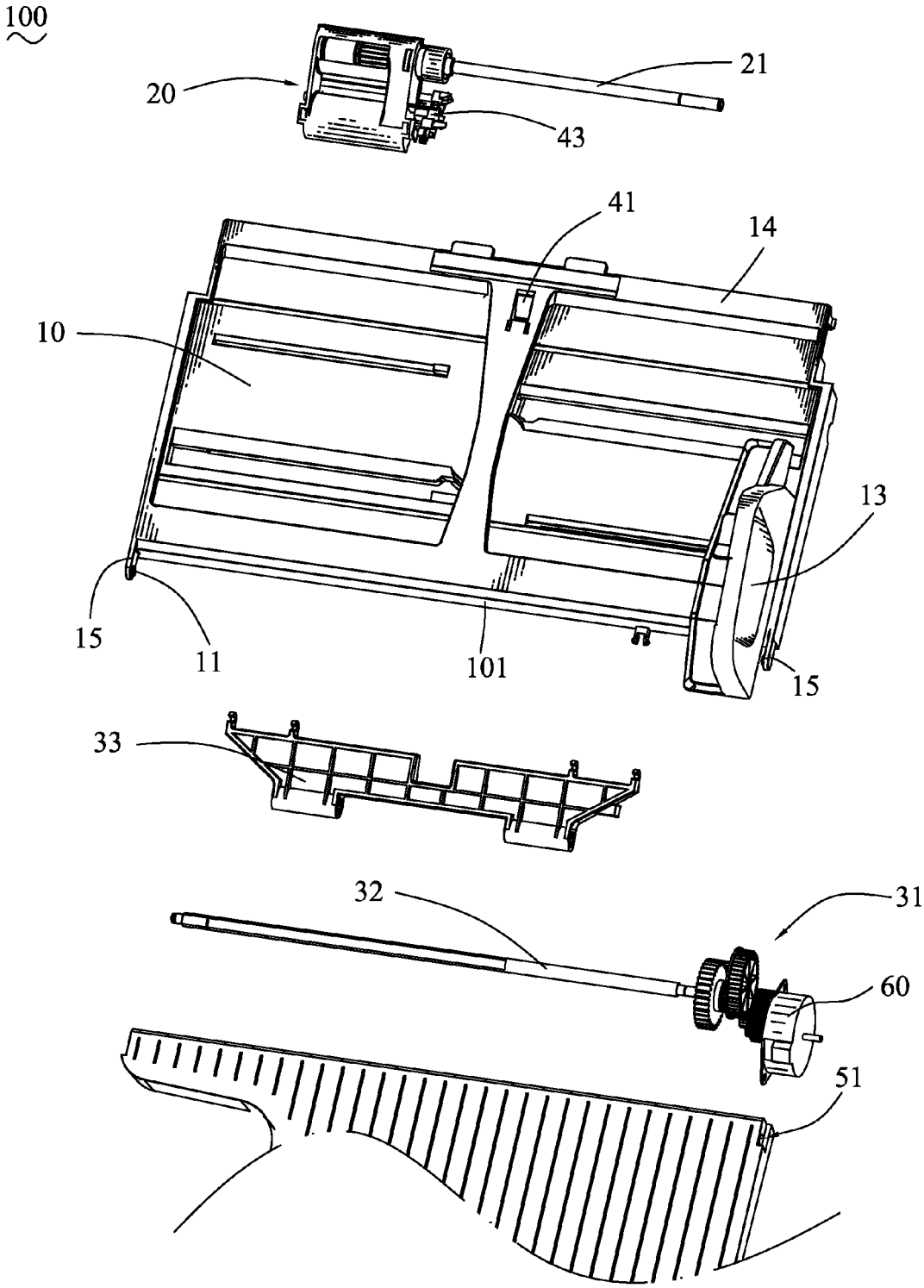
FIG. 3 is another exploded view of the paper feeding mechanism of FIG. 1.

Referring to FIG. 1, FIG. 2 and FIG. 3, two fronts of two opposite sides of the mechanical frame define two pivoting holes 51. The input tray 10 for holding papers thereon has a base board 14. Two opposite ends of a rear surface 101 of the base board 14 extend rearward to form two extending walls 15. Two inner surfaces of the two extending walls 15 protrude face to face to form two pivoting pillars 11. The pivoting pillars 11 are pivoted in the pivoting holes 51 so as to pivot a rear of the input tray 10 to the mechanical frame. A connecting wall 16 is extended downward from a front of a bottom surface 102 of the base board 14. Two ends of the connecting wall 16 are cut off to define two gaps 161. Two opposite end walls of each gap 161 extend forward along a short distance to form two lateral walls 162. A blocking wall 163 connects with the two lateral walls 162 and the bottom surface 102. A receiving space 12 is surrounded among the bottom surface 102, the two lateral walls 162 and the blocking wall 163. A limiting board 13 is disposed on one end of a top of the base board 14. A limiting piece 131 is protruded inward from an inner face of the limiting board 13, and is used for limiting a thickness of the papers on the input tray 10.

Referring to FIG. 1 and FIG. 2, the pickup assembly 20 is driven by the drive system 60 and is located above a front of the input tray 10. The pickup assembly 20 includes a pickup roller 21 and a pickup wheel 22 pivoted to one end of the pickup roller 21. The other end of the pickup roller 21 is fastened to the mechanical frame for securing the pickup assembly 20 to the mechanical frame. The pickup wheel 22 can wiggle upward and downward slightly to pick up the papers through a positive force.

Referring to FIG. 2 and FIG. 3, the elevating assembly 30 is mounted to the mechanical frame and pivoted to a bottom of the front of the input tray 10. The elevating assembly 30 includes a pulley 31 driven by the drive system 60, a fastening roller 32, a bracket 33 and a pair of buckling axes 34. Two ends of a rear side of the bracket 33 define two lying cylindrical fastening portions 331 of which each defines a fastening hole 332 transversely penetrating through the fastening portion 331. Each end of a front side of the bracket 33 defines two hooking portions 333 spaced from each other. Two opposite end surfaces of the two buckling axes 34 protrude oppositely to form two pivoting protrusions 341. The pulley 31 is mounted to the mechanical frame and connected with the drive system 60. One end of the fastening roller 32 is connected with the pulley 31. The other end of the fastening roller 32 passes through the fastening holes 332. The buckling axes 34 are pivoted to two face-to-face inner surfaces of the two lateral walls 162 of the receiving space 12. The two hooking portions 333 located on the same end of the front side of the bracket 33 hook the two pivoting protrusions 341 protruded from a same buckling axis 34. So the drive system 60 drives the pulley 31 to rotate so that further drives the fastening roller 32 to rotate and drives the bracket 33 to wiggle upward and downward so as to bring along the input tray 10 to rise and descend.

Referring to FIG. 1 and FIG. 2, the controlling assembly includes a controlling system (not shown), a paper sensor 41, a floating sensor 42 and a pickup sensor 43. The paper sensor 41 is used for detecting whether there are any papers on the input tray 10. The floating sensor 42 is used for detecting a position of the elevating assembly 30. The pickup sensor 43 is used for detecting a position of a bottom of the pickup wheel 22 of the pickup assembly 20 with respect to the papers on the input tray 10 to get a total thickness of the papers located on the input tray 10. The paper sensor 41 is mounted to the input tray 10 with a top end thereof projecting beyond the top of the base board 14 of the input tray 10. The floating sensor 42 is mounted to one side of the bracket 33 and located under the input tray 10. The pickup sensor 43 is mounted to one side of the pickup assembly 20 and located above the input tray 10.

Referring to FIG. 1, FIG. 2 and FIG. 3, working principle of the paper feeding mechanism 100 is described as following. When the paper feeding mechanism 100 is at an original status, the input tray 10 is positioned on the bracket 33. The floating sensor 42 detects the bracket 33 to be located at an original position and send a first detecting signal of the floating sensor 42 to the controlling system.

When there are some papers on the input tray 10, the papers press on the paper sensor 41 to make the paper sensor 41 detect the papers are located on the input tray 10, and the floating sensor 42 detects the bracket 33 is still located at the original position, the paper sensor 41 and the floating sensor 42 send a second detecting signal of the paper sensor 41 and the first detecting signal of the floating sensor 42 to the controlling system. The controlling system controls the drive system 60 to drive the pulley 31 to rotate to bring along the bracket 33 to wiggle upward so as to raise the input tray 10. Then the papers on the input tray 10 touch the bottom of the pickup wheel 22 of the pickup assembly 20, and raise the pickup wheel 22 to pivot the pickup roller 21 to wiggle upward to make the pickup wheel 22 trigger the pickup sensor 43. At this moment, the bottom of the pickup wheel 22 presses on the papers through the positive force. The pickup sensor 43 sends a third detecting signal of the pickup sensor 43 to the controlling system to control the pulley 31 to stop rotating, the input tray 10 stops rising, and the pickup assembly 20 begins picking up the papers. When some papers are picked up from the input tray 10, the thickness of the papers on the input tray 10 becomes thinner. The pickup wheel 22 of the pickup assembly 20 pivots the pickup roller 21 to wiggle downward to make the bottom of the pickup wheel 22 away from the pickup sensor 43. The pickup sensor 43 sends a fourth detecting signal of the pickup sensor 43 to the controlling system. So, the controlling system controls the drive system 60 to drive the pulley 31 to rotate again to bring along the bracket 33 to wiggle upward so as to raise the input tray 10 until the papers on the input tray 10 touch the bottom of the pickup wheel 22 of the pickup assembly 20 again, and raise the pickup wheel 22 to pivot the pickup roller 21 to wiggle upward to make the pickup wheel 22 trigger the pickup sensor 43 again. Thus, the bottom of the pickup wheel 22 presses on the papers through the positive force to pick up the papers again. Repeat the above-mentioned actions to modulate a position of the input tray 10 in actual time to ensure the bottom of the pickup wheel 22 of the pickup assembly 20 touch the papers on the input tray 10 really so as to make sure the positive force exerted on the papers by the pickup assembly 20 steadily and forceful.

When there is no paper on the input tray 10, the paper sensor 41 sends a fifth detecting signal of the paper sensor 41 to the controlling system, the controlling system controls the drive system 60 to drive the pulley 31 to bring along the input tray 10 to return to the original position.

As described above, the paper feeding mechanism 100 detects the position of the bottom of the pickup wheel 22 of the pickup assembly 20 with respect to the papers on the input tray 10 through the pickup sensor 43 to get the total thickness of the papers on the input tray 10 so as to modulate the position of the input tray 10 in actual time to ensure the bottom of the pickup wheel 22 of the pickup assembly 20 to touch the papers on the input tray 10 really. As a result, the bottom of the pickup wheel 22 presses on the papers through the steady positive force so as to make the pickup wheel 22 pick up the papers on the input tray 10 steadily.

What is claimed is:

1. A paper feeding mechanism, comprising:

a mechanical frame;

a drive system mounted to the mechanical frame;

an input tray for holding papers thereon, a rear of the input tray being pivoted to the mechanical frame;

a pickup assembly driven by the drive system and located above the input tray, the pickup assembly including a pickup roller, and a pickup wheel pivoted to one end of the pickup roller to wiggle upward and downward, the other end of the pickup roller being fastened to the mechanical frame for securing the pickup assembly to the mechanical frame;

an elevating assembly mounted to the mechanical frame and driven by the drive system, the elevating assembly being pivoted to a bottom of the input tray and bringing along the input tray to rise and descend; and a controlling assembly including a controlling system, a paper sensor, a floating sensor and a pickup sensor, the paper sensor being mounted to the input tray with a top end thereof projecting beyond a top of the input tray to detect whether there are any papers on the input tray, the floating sensor being mounted to one side of the elevating assembly to detect a position of the elevating assembly, the pickup sensor being mounted to one side of the pickup assembly to detect a position of a bottom of the pickup wheel of the pickup assembly with respect to the papers on the input tray to get a total thickness of the papers located on the input tray, the controlling system controlling the drive system to drive the elevating assembly to wiggle upward and downward to bring along the input tray to rise and descend according to the total thickness of the papers located on the input tray, so as to make the pickup wheel of the pickup assembly pick up the papers on the input tray steadily.

2. The paper feeding mechanism as claimed in claim 1, wherein the elevating assembly includes a pulley, a fastening roller and a bracket, the pulley is mounted to the mechanical frame and connected with the drive system, a front side of the bracket is pivoted to the input tray, the fastening roller is connected between the pulley and the bracket, the drive system drives the pulley to rotate so that further drives the fastening roller to rotate and drives the bracket to wiggle upward and downward so as to bring along the input tray to rise and descend.

3. The paper feeding mechanism as claimed in claim 2, wherein the floating sensor is mounted to one side of the bracket and located under the input tray.

4. The paper feeding mechanism as claimed in claim 2, wherein a rear side of the bracket defines two fastening portions of which each defines a fastening hole transversely penetrating therethrough for receiving one end of the fastening roller.

5. The paper feeding mechanism as claimed in claim 2, wherein the elevating assembly further includes two buckling axes of which each has two pivoting protrusions protruded oppositely at two opposite end surfaces thereof, each end of the front side of the bracket defines two hooking portions, the bottom of the input tray defines a receiving space, the buckling axes are pivoted to two face-to-face inner surfaces of the receiving space, the two hooking portions located on the same end of the front side of the bracket hook the two pivoting protrusions protruded at the two opposite end surfaces of the same buckling axis.

6. The paper feeding mechanism as claimed in claim 1, wherein two opposite sides of the mechanical frame define two pivoting holes, the input tray has two extending walls at a rear thereof, two inner surfaces of the two extending walls protrude face to face to form two pivoting pillars pivoted in the pivoting holes.

* * * * *